US006120308A

United States Patent [19]

Hayashi

[11] Patent Number: 6,120,308

[45] Date of Patent: Sep. 19, 2000

[54] ELECTRICAL CONNECTOR ASSEMBLY WHICH CAN BE ROTATABLY CONNECTED AND DISCONNECTED

[75] Inventor: Hiroyuki Hayashi, Nagoya, Japan

[73] Assignees: Sumitomo Wiring Systems, Ltd.; Harness System Technologies Research; Sumitomo Electric Industries, Ltd., all of Japan

[21] Appl. No.: 09/088,925

[22] Filed: Jun. 2, 1998

[30] Foreign Application Priority Data

Jul. 1, 1997 [JP] Japan ..... 9-176172
Jul. 1, 1997 [JP] Japan ..... 9-176173

[51] Int. Cl.[7] ..... H01R 13/62

[52] U.S. Cl. ..... 439/157

[58] Field of Search ..... 439/157, 160, 439/310

[56] References Cited

U.S. PATENT DOCUMENTS 4,332,432 6/1982 Colleran ..... 439/157

*Primary Examiner*—Steven L. Stephan
*Assistant Examiner*—Javaid Nasri
*Attorney, Agent, or Firm*—Jordan B. Bierman; Bierman, Muserlian and Lucas

[57] ABSTRACT electrical connector assembly including a first connector supported by a holder and a second connector coupled to the first connector. At least one rocking lever is supported rotatably by a support pin with driving means for moving the rocking lever in accordance with a sliding displacement of the first connector along the holder when interconnecting the first and second connectors. Actuating means displaces the second connector toward the first connector by transmitting the driving force of the rocking lever to the second connector. Each pair of protection ribs is provided on the opposite sides of the mounting portion of the rocking lever to protect the lever. A pair of support lances formed on the holder holds the first connector temporarily in a waiting position for coupling. The electrical connector assembly is simple in structure and compact in size and it is possible to easily and properly interconnect the first and second connectors and to confirm at a glance whether the connectors are completely coupled to each other.

7 Claims, 4 Drawing Sheets

ELECTRICAL CONNECTOR ASSEMBLY WHICH CAN BE ROTATABLY CONNECTED AND DISCONNECTED

BACKGROUND OF THE INVENTION

This invention relates to an electric connector assembly which interconnects first and second connectors associated to each other to make an electrical conduction therebetween.

Heretofore, in a connector assembly having a multiple-pole structure which has many terminals and causes a high resistance of connection, for example, a connector assembly shown in Japanese Utility Model Public Disclosure No. HEI 3-126379 (1991), in order to enhance a coupling of the assembly, driving means include actuating means which are driven by a working person and a cam plate which drives a pair of connectors to a coupling position. A driving force applied to the actuating means is amplified by the cam plate and is converted into a coupling force for the connectors. The connectors are coupled to each other by using the driving means.

In the above connector assembly, when the actuating means in the driving means are turned, cam pins of a pair of cam followers provided on one of connector housings enter cam grooves in the driving means which clamp the other connector housing at the opposite sides, and an amplified great thrust force is applied to the opposite sides of the connector housing on the side of the cam follower, thereby coupling the connectors to each other readily and positively.

In the connector assembly having the above structure, since the driving means which are turned by a working person are disposed on the exterior of the connector housing, the driving means are easy to be broken by a contact with a obstacle, a peripheral device, or the like when carrying or using the connector assembly. In the connector assembly disclosed in the above publication, the driving means are protected by providing a cantilever type of protection plate on a mounting portion for the driving means and arranging the driving means between the protection plate and an outer surface of the connector housing. However, this makes a structure of the connector housing complicated and bulky.

Although the above connector assembly has an advantage that a working person can easily confirm a complete coupling of the connectors by a position of the driving means turned by the working person, it is necessary to provide the cantilever type of the protection plate on the mounting portion for the driving means in order to prevent the driving means from being broken by a contact with an obstacle, a circumferential device, or the like. This results in a connector housing having a complicated and bulky structure.

SUMMARY OF THE INVENTION

An object of the present invention is to provide an electrical connector assembly which is simple in structure and compact in size and which can easily and properly interconnect a first connector and a second connector.

Another object of the present invention is to provide an electrical connector assembly which is simple in structure and compact in size and in which complete coupling between the first and second connectors can be confirmed at a glance.

In order to achieve the above objects, an electrical connector assembly comprises: a first connector; a second connector detachably coupled to the first connector; a holder having a pair of support lances which detachably hold the first connector; and at least one rocking lever which is rotatably mounted on the first connector. Rotary displacement of the rocking lever connects and disconnects the first and second connectors to and from each other through the holder.

In the above electrical connector assembly, the rocking lever is rotatably supported on the first connector through a support pin. Driving means for moving the rocking lever in accordance with a sliding displacement of the first connector in the holder when interconnecting the first and second connectors and actuating means for displacing the second connector toward the first connector by transmitting a driving force of the rocking lever to the second connector while increasing the driving force are provided in and on the holder and the first connector. Each pair of protection ribs are provided on the opposite sides of a mounting portion of the rocking lever to protect the lever.

According to the above structure, the rocking lever disposed between the holder and the first connector is protected by the protection ribs and the first connector is linearly displaced in the holder by the actuating force which interconnects the first and second connectors. Then, the rocking lever is rotated by the driving force applied from the driving means. The driving force is transmitted through the actuating means to the second connector, thereby coupling the connectors to each other by a great force.

The pair of protection ribs for protecting the rocking lever may be asymmetrically provided with respect to a center line of a connector housing of the first connector thereon. A pair of guide grooves corresponding to the pair of protection ribs may be formed in a connector housing of the second connector.

According to the above structure, the rocking lever is protected by the pair of protection ribs. The pair of protection ribs formed on the connector housing of the first connector engage with the pair of guide grooves formed in the connector housing of the second connector, thereby coupling the connectors to each other.

Further, in the electrical connector assembly described above, the pair of support lances formed on the holder may hold the first connector temporarily in a waiting position for the coupling. A part of each of the support lances may be exposed out of the first and second connectors at a complete coupling position of the first and second connectors.

According to the above structure, when the first connector which is temporarily held by the support lances of the holder is coupled to the second connector, a part of each support lance appears out of the connectors. Thus, it is possible to confirm at a lance whether the connectors are in the complete coupling position on the basis of an extent of disposed length of the support lances.

Each of the support lances may be provided on a front part of each of the opposite sides of the holder. The second connector may be provided on a rear wall thereof with openings adapted to permit distal ends of the support lances to pass therethrough.

According to the above structure, when the first connector is coupled to the second connector, the distal end of each support lance appears through the opening in the rear wall of the second connector whereby a complete coupling between the connectors can be confirmed at a glance on the basis of the exposed extent of the support lance.

A rocking lever rotatably mounted on a support pin, driving means for moving the rocking lever in accordance with a sliding displacement of the first connector along the holder when interconnecting the first and second connectors and actuating means for displacing the second connector toward the first connector by transmitting a driving force of the rocking lever to the second connector while increasing the driving force may be provided between the holder and the first connector.

According to the above structure, the first connector which is temporarily held in the holder by the support lances is released in response to the actuating force for interconnecting the first and second connectors and then the first connector is moved in the holder. The rocking lever is rotated in accordance with the driving force from the driving means. The driving force is increased and transmitted from the actuating means to the second connector, thereby interconnecting the connectors with a great force. The distal ends of the support lances appear out of the connectors.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

DETAILED DESCRIPTION OF THE PREFERRED EMBODIMENTS

Figure 1:
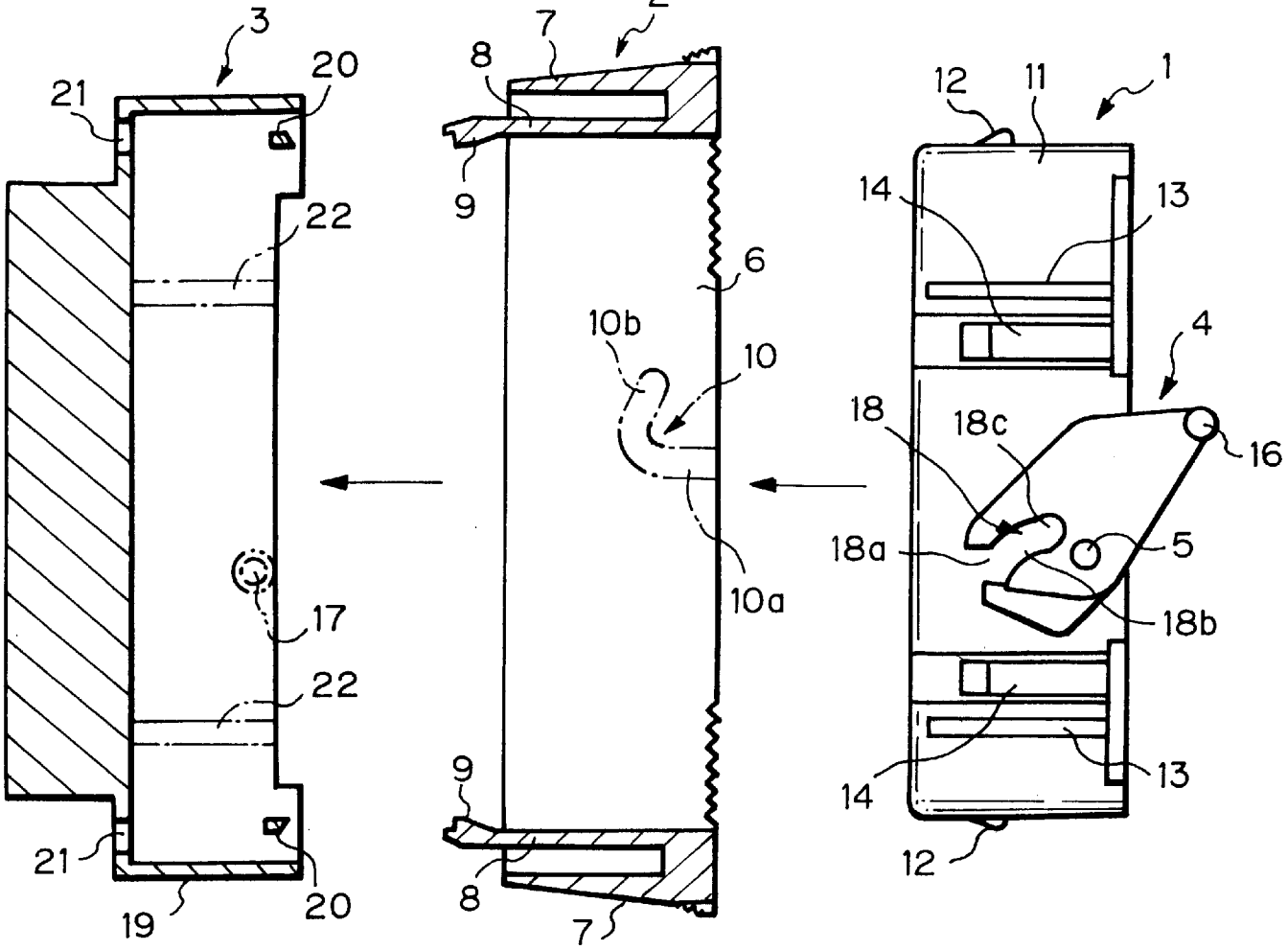
FIG. 1 is an exploded longitudinal sectional view of an embodiment of an electrical connector assembly in accordance with the present invention.

Referring now to the drawings, an embodiment of an electrical connector assembly in accordance with the present invention will be described below.

Figure 2:
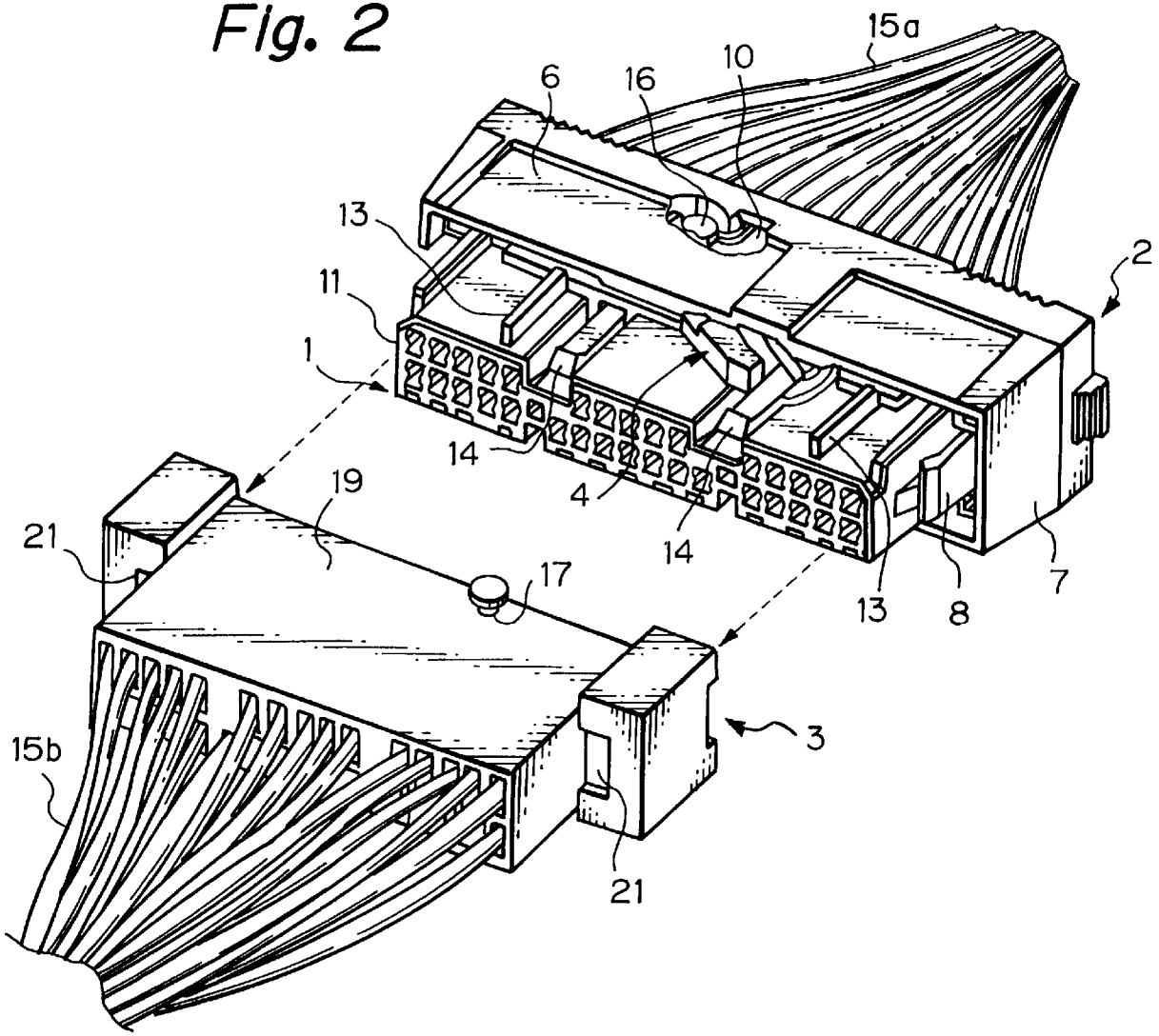
FIG. 2 is an exploded perspective view of the electrical connector assembly shown in FIG. 1.

FIGS. 1 and 2 show an embodiment of the electrical connector assembly of the present invention. The electrical connector assembly includes a first connector 1, a holder 2 which holds the first connector 1, and a second connector 3 to be coupled to the first connector 1. A rocking lever 4, which rotates in a direction of coupling the second connector 3 to the first connector 1 upon a coupling operation of the connectors 1 and 3, is rotatably disposed through a support pin 5 between the first connector 1 and the holder 2. The support pin 5 may be secured to either the first connector 1 or the rocking lever 4.

The holder 2 includes upper and lower walls 6, 6, right and left side walls 7, 7 to form an angular sleeve. The holder 2 is provided on the inner surface of each side wall 7 with a support lance 8 which serves to hold the first connector 1 in a waiting position for the coupling or a temporary lock position. Each support lance 8 is a cantilever type configuration which extends forwardly along the inner surface of the side wall 7 of the holder 2 from a rear end of the side wall 7. A-length of the support lance 8 is selected so that a distal end of the support lance 8 passes through a rear wall of the second connector 3 by a given distance in a complete coupling position of the first and second connectors 1 and 3, which will be described later. The support lance 8 is provided on an inner surface of the distal end thereof with a lock projection 9. The lock projection 9 has a tapered surface at a rear part.

The upper or lower wall 6 of the holder 2 is provided with a receiving groove 10 which serves to engage with an engaging pin 16 mounted on an upper surface of a rear end of the rocking lever 4. The receiving groove 10 comprises an inlet part 10*a* which extends forwardly from a rear end edge of the holder 2 and a driving part 10*b* which extends laterally from an end of the inlet part 10 *a*. A combination of the driving part 10*b* of the receiving groove 10 and the engaging pin 16 projecting from the rocking lever 4 constitutes driving means for turning the rocking lever 4 upon the coupling operation of the connectors 1 and 3.

Receiving grooves 10, 10 are formed in upper and lower walls 6, 6 of the holder 2 symmetrically when seen from a top view while rocking levers 4 are rotatably mounted on the upper and lower walls of the first connector 1 symmetrically when seen from a top view. The lower receiving groove 10 and the lower rocking lever 4 are not shown in the drawings. The lower rocking lever 4 turns similarly to the upper rocking lever 4 but in an opposite direction to it by sliding a lower engaging pin 16 in a driving part 10*b* of the lower receiving groove 10.

The first connector 1 is adapted to be slidably supported in the holder 2 and includes a connector housing 11 which contains a plurality of female terminals (not shown). Electrical cables 15*a* connected to the female terminals extend outwardly from a rear end of the connector housing 11. The connector housing 11 is provided on each of opposed side walls with a temporary lock pawl 12 which engages with the projection 9 of the support lance 8 to temporarily hold the first connector 1 in the waiting position at the front end of the holder 2. The temporary lock pawl 12 has a tapered surface on the front end thereof.

The support pins 5 are secured to upper and lower walls of the connector housing 11 to rotatably support the upper and lower rocking levers 4, respectively. A pair of ribs 13, 13 are provided on the opposite sides of each rocking lever on each of the walls of the connector housing 11 to extend in a coupling direction of the connectors. The ribs 13, 13 are disposed asymmetrically with respect to a center line of the connector housing 11 thereof so as to prevent one of the connector housings 11 and 19 from being coupled to the other of the housings upside down. A pair engaging ridges 14, 14 are formed between the ribs 13 and 13 on each of the upper and lower walls of the connector housing 11 so that the ridges 14, 14 engage with grooves (not shown) in the connector housing 19 of the second connector 3 to lock the connectors 1 and 3 in the complete coupling position.

The rocking lever 4 is made of a plate material which is suitable for pivoting on the support pin 5. The engaging pin 16 to be engaged with the receiving groove 10 in the holder 2 is provided on a rear end of the rocking lever 4 at a position spaced away from the support pin 5 by a predetermined distance. A combination of the receiving groove 10 in the holder 2 and the engaging pin 16 on the rocking lever 4 constitutes driving means for turning the rocking lever 4 upon an operation of coupling the connectors 1 and 3.

Moreover, a guide groove 18 is formed in a front end of the rocking lever 4 to receive a follower pin 17 provided on the connector housing 19 of the second connector 3. The guide groove 18 includes an inlet part 18*a* for introducing the follower pin 17 into the groove 18, an arcuate actuating part 18*b* extending rearward from the terminal end of the inlet part 18*a*, and a lock part 18*c* extending from an end of the engaging part 18*b* in an arcuate path coaxial with the support pin 5.

The arcuate actuating part 18*b* is formed so that a distance between the part 18*b* and the support pin 5 becomes gradually small from front end of the part 18*b* to a rear end of the part 18*b*. A combination of the actuating part 18*b* in the rocking lever 4 and the follower pin 17 on the second connector 3 constitutes actuating means which transmit the driving force applied to the rocking lever 4 from the driving means to the second connector 3 and move the second connector 3 to the first connector 1.

Upon interconnection of the connectors 1 and 3, the connector housing 11 of the first connector 1 slides in the holder 2 which the rocking lever 4 is driven by the driving means. When the rocking lever 4 pivots on the support pin 5, the follower pin 17 slides in the actuating part 18*b* in the rocking lever 4. Consequently, the follower pin 17 is moved toward the support pin 5 so that the second connector 3 is coupled to the first connector 1.

The position and configurations of the receiving groove 10 and actuating part 18*b* of the guide groove 18 with respect to the support pin 5 are set so that an amount of displacement of the second connector 3 in the coupling direction is smaller than an amount of displacement of the first connector 1 which slides in the holder 2. Thus, the driving force applied to the rocking lever 4 from the driving means is increased and transmitted from the actuating part 18*b* to the follower pin 17 on the second connector 3. Although the actuating part 18*b* of the guide groove 18 in the rocking lever 4 is formed into an arcuate shape in the above embodiment, it may be formed into a linear shape or a parabolic shape extending inwardly from the inlet part 18*a* to the lock part 18*c*.

The second connector 3 is fitted on the exterior of the connector housing 11 of the first connector 1. The second connector 3 has a connector housing 19 which contains a plurality of male terminals (not shown). Electrical cables 15*b* connected to the terminals are drawn outwardly from a front end of the connector housing 19. The connector housing 19 is provided on each side wall with an actuating projection 20 which comes into contact with the lock projection 9 on each support lance 8 to deflect the lance 8 in a direction of releasing the first connector 1 from the temporary lock position when interconnecting the first and second connectors 1 and 3. The actuating projection 20 has a tapered surface on a rear outer end.

The-connector housing 19 is provided on each of right and left rear end walls with an opening 21 which is opposed to the distal end of each support lance 8. When the connectors 1 and 3 are coupled to each other, the distal ends of the support lances 8 pass through the openings 21 and are exposed on the front sides of the second connector 3, respectively. Moreover, the connector housing 19 is provided in each of inner surfaces of upper and lower walls with a pair of slide grooves 22 which are opposed to the ribs 13 of the first connector 1.

Figure 3:
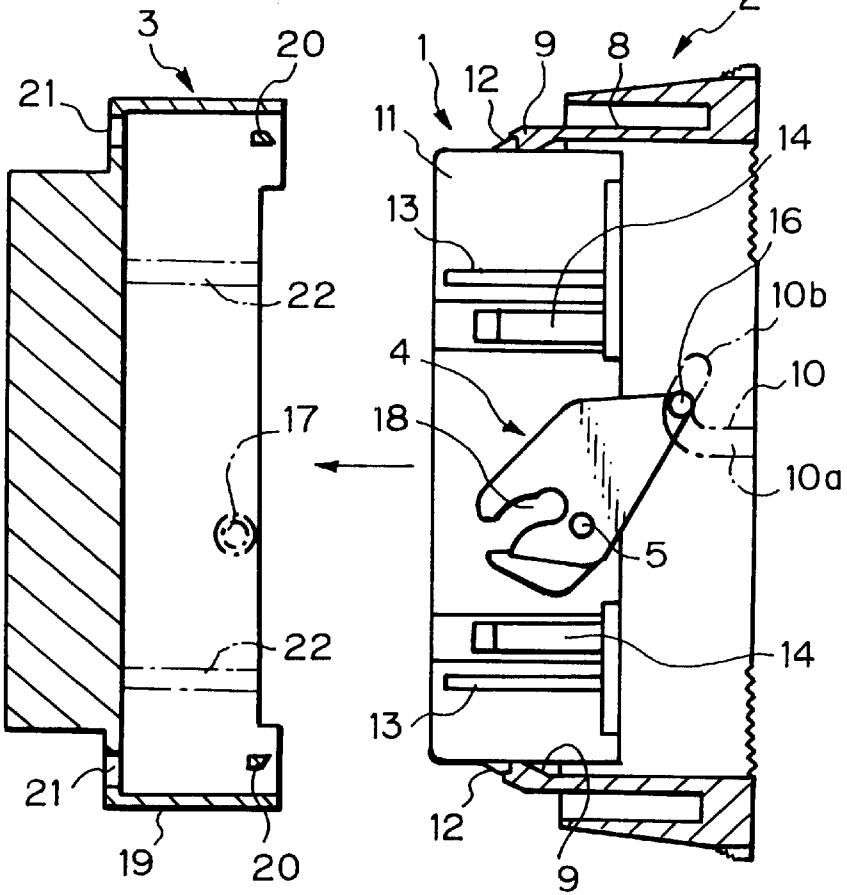
FIG. 3 is an exploded longitudinal sectional view of the electrical connector assembly shown in FIG. 1, illustrating a first connector which is temporarily locked on a holder.

In the case where the first and second connectors 1 and 3 are coupled to each other, the female terminals are contained in the male connector housing 11, each rocking lever 4 is pivotably mounted on each support pin 5 on the connector housing 11, the first connector 1 is opposed to the rear opening in the holder 2 and then inserted into the holder 2. Thus, as shown in FIG. 3, the first connector 1 is disposed in a waiting position or a temporary lock position in the holder 2.

That is, the first connector 1 is temporarily locked in the waiting position with the front surface of the lock projection 9 of the support lance 8 being in contact with the rear surface of the temporary lock projection or pawl 12 on the first connector, by bringing the front tapered surface of the projection 12 into contact with the projection 9, and sliding the projection 9 over the projection 12 which resiliently deflecting the distal end of the support lance 8 outwardly.

In response to insertion of the first connector 1 into the holder 2, the engaging pin 16 on the rear end of the rocking lever 4 enters the driving part 10*b* of the receiving groove 10 in the holder 2 through the inlet part 10*a* of the groove 10, thereby coupling the rocking lever 4 to the holder 2.

Next, the protection ribs 13, 13 on the connector housing 11 of the first connector 1 are opposed to the guide grooves 22, 22 in the connector housing 19 of the second connector 3, the connectors 1 and 3 are approached to each other so that the connector housing 19 enters a space defined between the holder 2 and the connector housing 11, and then the connectors 1 and 3 are being coupled to each other.

Figure 4:
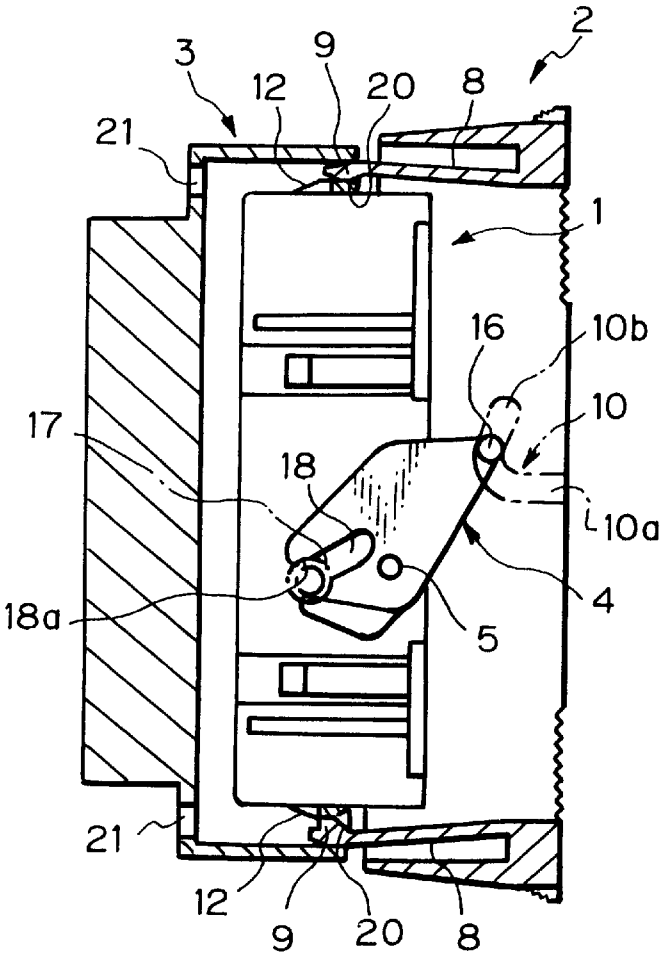
FIG. 4 is a longitudinal sectional view of the electrical connector assembly shown in FIG. 1, illustrating the first connector which is released from the temporary lock position on the holder.

Upon interconnection of the connectors 1 and 3, as shown in FIG. 4, each actuating projection 20 on the second connector 3 pushes up the lock projection 9 on each support lance 8 to resiliently deflect each support lance 8 outwardly, thereby releasing the first connector 1 from its temporary lock position. Then, the second connector 3 pushes the first connector 1 rearwardly to slide the connector 1 rearwardly in the holder 2.

Figure 5:
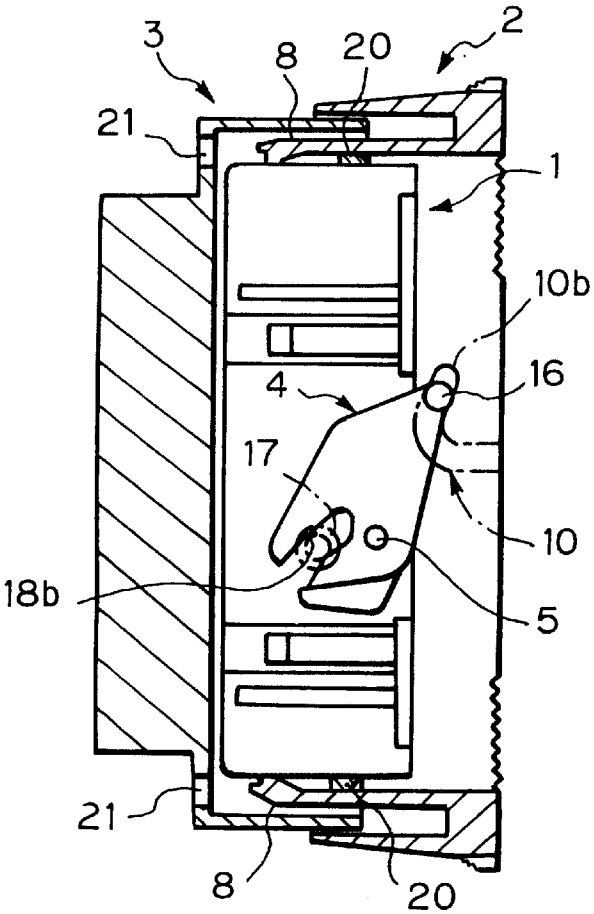
FIG. 5 is a longitudinal sectional view of the electrical connector assembly, illustrating the first connector which is further advanced into a second connector from the position shown in FIG. 4.

When the first and second connectors 1 and 3 are coupled to each other, the follower pin 17 on the second connector 3 enters the guide groove 18 in the rocking lever 4, thereby coupling the follower pin 17 and rocking lever 4 to each other. As shown in FIG. 5, the second connector 3 is further pushed into the holder 2. When the first connector 1 slides rearwardly in the holder 2, the engaging pin 16 on the rocking lever 4 slides in the driving part 10*b* of the receiving groove 10, thereby turning the rocking lever 4 about the support pin 5 in the counterclockwise direction in FIG. 5.

The follower pin 17 on the second connector 3 slides in the actuating part 18*b* of the guide groove 18 in association with the turning displacement of the rocking lever 4. Thus, the follower pin 17 is moved toward the support pin 5, thereby moving the second connector 3 to the first connector 1.

Since the amount of displacement of the second connector 3 in the coupling direction which is driven by the rocking lever 4 is set to be smaller than the amount of sliding displacement of the first connector 1 relative to the holder 2, the driving force-applied to the rocking lever 4 from the driving means is increased and transmitted from the actuating part 18*b* to the follower pin 17. Consequently, the second connector 3 is pushed to the first connector 1 by a great driving force to be transmitted from the actuating part 18*b* in the rocking lever 4 through the follower pin 17 to the second connector 3, thereby surely coupling the connectors 1 and 3 to each other.

Figure 6:
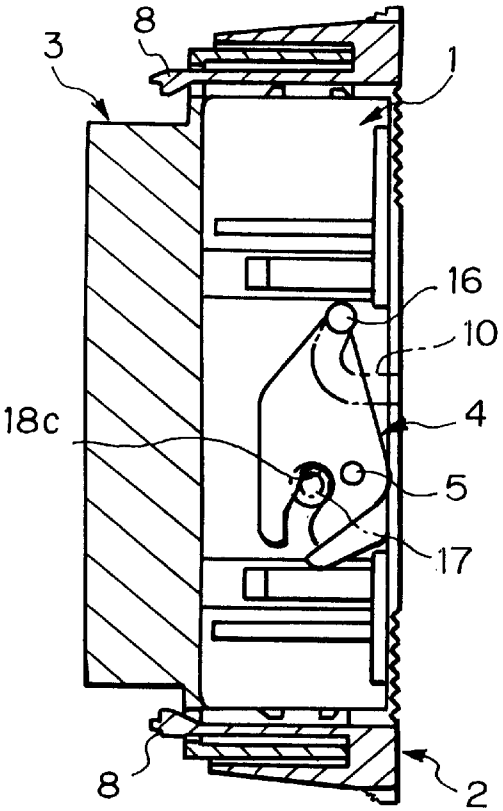
FIG. 6 is a longitudinal sectional view of the electrical connector assembly, illustrating the first connector which is completely coupled to the second connector.

In the final step of coupling the first and second connectors 1 and 3 to each other, as shown in FIG. 6, the follower pin 17 on the second connector 3 enters the lock part 18*c* of the guide groove 18 in the rocking lever 4, the connectors 1 and 3 which are fitted together with each other slide into the holder 2. The distal end of each support lance 8 passes through the opening 21 in the second connector 3 to appear outside the connector 3. The engaging ridges 14, 14 of the first connector 1 engage with the lock elements (not shown) of the second connector 3 to maintain the connectors 1 and 3 in the complete coupling position.

The interconnection of the first and second connectors 1 and 3 is released by sliding the second connector 3 forwardly with respect to the holder 2 and sliding the rocking lever 4 and first connector 1 rearwardly with respect to the holder 2 while turning the rocking lever 4 in the direction opposite to the coupling direction.

As described above, in the electrical connection assembly of the present invention, the rocking lever 4 is rotatably supported on the first connector 1 through the support pin 5. The driving means for moving the rocking lever 4 in accordance with a sliding displacement of the first connector 1 in the holder 2 when interconnecting the first and second connectors 1 and 3, and the actuating means for displacing the second connector 3 toward the first connector 1 by transmitting the driving force of the rocking lever 4 to the second connector 3 while increasing the driving force are provided in and on the holder 2 and the first connector 1. Each of the protection ribs 13 is provided on the opposite sides of the mounting portion of the rocking lever 4 to protect the lever 4. Accordingly, the rocking lever 4 can be effectively protected by a simple and compact structure. It is possible to prevent the rocking lever 4 from breaking by a contact with an obstacle or a peripheral device when carrying or using the connector assembly. It is also possible to prevent electrical cables 15*a* connected to the terminals from entering a gap between the rocking lever 4 and the first connector 1, thereby preventing an entanglement of the cables 15*a* on the rocking lever 4.

The driving means comprising the engaging pin 16 and the driving part 10*b* of the receiving groove 10 turn the rocking lever 4 while the actuating means comprising the follower pin 17 and the actuating part 18*b* of the guide groove 18 move the second connector 3 in the coupling direction by merely pushing the second connector 3 toward the first connector 1. This causes the connectors 1 and 3 to be in the coupling position, easily and surely.

In particular, in the above embodiment, the pair of protection ribs 13, 13 for protecting the rocking lever 4 are asymmetrically provided on the connector housing 11 of the first connector 1. The slide grooves 22, 22 corresponding to the protection ribs 13, 13 are formed in the connector housing 19 of the second connector 3. Accordingly, positioning of the connector housing 11 and 19 can be effected by a combination of the protection ribs 13, 13 and slide grooves 22, 22, thereby preventing the connector housings 11 and 19 from being fitted upside down.

Although the slide grooves 22, 22 corresponding to the protection ribs 13, 13 on the connector housing 11 of the first connector 1 are formed into recess shapes in the connector housing 19 of the second connector 3 in the above embodiment, the groves 22, 22 may be formed into slot shapes. These slot type slide grooves do not require any spaces between the protection ribs 13, 13 and the holder 2 in order to receive the connector housing 19 of the second connector 3. It is possible to effectively protect the rocking lever 4 by means of the protection ribs 13, 13, if a height of the protection rib 13 is substantially equal to a width of the clearance between the housing 11 and the holder 2.

As described above, the electrical connector assembly of the present invention comprises the first connector 1, the holder 2 which holds the first connector 1, and the second connector 3 being coupled to the first connector 1. The support lances 8 formed on the holder 2 hold the first connector 1 temporarily in a waiting position for the coupling. The distal end of each support lance 8 is exposed out of the first and second connectors 1 and 3 in the complete coupling position of the first and second connectors 1 and 3. Accordingly, it is possible to easily and correctly confirm the complete coupling of the connectors 1 and 3 by judging the extent of exposition of the distal ends of the support lances 8 after coupling the connectors 1 and 3 to each other.

The support lances 8 temporarily holds the first connector 1 in the waiting position for the coupling prior to interconnection of the connectors 1 and 3. Even if the support lances 8 are actuated by mistake under interconnection of the connectors 1 and 3, the interconnection is not released. In addition, since the coupling condition of the connectors can be confirmed by means of exposition of a part of each support lance 8 outside the connectors 1 and 3, a main part of the support lance 8 is contained in the holder 2 and thus a simple and compact structure can prevent the support lance 8 from being broken.

In particular, in the above embodiment, each support lance 8 is provided on a front part of each of the opposite sides of the holder 2. The second connector 3 is provided on a rear wall thereof with openings 21 which permit the distal ends of the support lances 8 to pass through the rear 14 wall. Consequently, it is possible to prevent the support lances 8 from catching the electrical cables 15*a* and 15*b* connected to the terminals in the connectors 1 and 3 and it is also possible to indicate the complete coupling of the connectors 1 and 3 by confirming the extent of exposition of the distal ends of the support lances 8.

In the above embodiment, the rocking lever 4 is pivotably mounted on the support pin 5 on the first connector 1 so that the rocking lever 4 is disposed between the first connector 1 and the holder 2. The driving means comprising-the engaging pin 16 and the driving part 10*b* turn the rocking lever 4 in accordance with a sliding displacement of the first connector 1 in the holder 2 when interconnecting the first and second connectors 1 and 3. The actuating means comprising the follower pin 17 and the actuating part 18*b* displace the second connector 3 toward the first connector 1 by transmitting the driving force of the rocking lever to the second connector 3 while increasing the driving force. Accordingly, a great force can be applied to the connectors 1 and 3 by merely pushing the first or second connector 1 or 3 toward the second or first connector 3 or 1, thereby surely coupling the connectors 1 and 3.

Since the rocking lever 4 is disposed between the holder 2 and the first connector 1 in the above embodiment, it is possible to turn the rocking lever 4 without forming a dead space caused by extension of the lever outside the connector. Further, it is possible to make the connectors smaller in height by making the rocking lever 4 from a relatively thin plate material.

In the above embodiment, the rocking lever 4 is mounted on each of the upper and lower walls of the first connector 1 so that the rocking levers 4 are arranged in symmetrical positions with respect to a center point of the housing 11 when seen from a top view. Such a symmetrical arrangement of the rocking levers 4 can apply a uniform force of coupling to the first and second connectors 1 and 3, thereby correctly coupling the connectors to each other. That is, if the electrical connector assembly has a great width, the rocking lever 4 is disposed on an end of each of the upper and lower walls of the first connector 1 so that the coupling force is applied onto a diagonal of the assembly. This can prevent a failure of coupling due to a deviated force of coupling to the second connector 3.

Since the rocking levers 4 on the upper and lower walls of the first connector 1 are set to turn in the opposite directions to each other, the driving forces are transmitted from the rocking levers 4 to the second connector 3 in the opposite directions to each other when seen from a top view, thereby cancelling the components in a widthwise direction of the driving forces. This causes the second connector 3 to slide in the holder 2 straight, thereby properly coupling the connectors 1 and 3 each other.

A pair of rocking levers 4 are formed into the same shape. One of the rocking levers 4 is mounted on one of the upper and lower walls of the first connector while the other rocking lever 4 is mounted on the other wall inside out. This reduces the number of parts of the assembly and enhances the straight sliding displacement of the second connector 3 by using one of the rocking levers 4 inside out.

Alteratively, only one rocking lever 4 may be mounted on either an upper or lower wall of the first connector 1 or a pair of rocking levers 4 may be mounted on the upper and lower walls of the connector 1, respectively. In the latter case, each pair of rocking levers may turn in the same direction.

In place of the structure in which the engaging pin 16 on the rocking lever 4 enters the receiving groove 10 in the holder 2, the engaging pin 16 may be provided on the holder 2 and the receiving groove 10 may be formed in the rocking lever 4. Moreover, the rocking lever 4 may be pivotably mounted on the holder 2 and the driving part 10*b* of the receiving groove 10 or the engaging pin 16 may be formed in the connector housing 11 of the first connector 1.

In the above embodiment, the support lances 8 on the holder 2 hold the first connector 1 in the waiting position for the coupling temporarily, the first connector 1 is released from the support lances upon interconnection of the first and second connectors 1 and 3, and the distal ends of the support lances 8 are exposed outside the connectors 1 and 3 in the complete coupling position. Accordingly, it is possible to easily and properly judge the complete coupling of the connectors 1 and 3 by confirming the exposition of the distal ends of the support lances 8.

The support lances 8 hold temporarily the first connector 1 in the waiting position for the coupling before interconnecting the connectors 1 and 3. Even if the support lances 8 are operated by mistake under interconnection of the connectors 1 and 3, there is no problem of releasing the interconnection of the connectors. Only a part of each support lance 8 is exposed outside the connectors 1 and 3 and indicates the complete coupling of them. An almost part of each support lance 8 is accommodated in the holder 2 and thus the support lance 8 is protected from breakage by means of a simple and compact structure.

The support lances 8 extend from the opposite side walls of the holder 2 and the openings 21 are formed in the rear wall of the second connector 3 to permit the distal ends of the support lances 8 to pass through the openings 21. This prevents the support lances 8 from catching the electrical cables 15*a* and 15*b* connected to the terminals in the connectors 1 and 3. It is possible to judge the complete coupling of the connectors 1 and 3 at a glance by confirming the exposition of the distal ends of the support lances 8 outside the openings 21.

The temporary condition of the first connector 1 in which the support lances 8 holds the first connector 1 in the waiting position for the coupling is automatically released by pushing up the lock projections 9 on the support lances 8 by means of the actuating projections 20 on the second connector 3 when coupling the connectors 1 and 3 to each other. The connectors 1 and 3 can be easily and surely changed from the temporary coupling condition to the complete coupling condition by one touch to the connectors 1 and 3 in the coupling direction.

In the case where the rear end of the lock projection 9 of each support lance 8 and the front end of each temporary lock projection 12 on the first connector 1 have tapered surfaces, respectively, the first connector 1 is inserted into the holder 2 from the rear opening to come into contact with the tapered surfaces and is slid into the waiting position for the coupling while outwardly deflecting the distal ends of the support lances 8.

In the above embodiment, the protection ribs 13, 13 are provided on the opposite sides of the rocking lever 4 on the connector housing 11 of the first connector 1. The protection ribs 13, 13 serve to protect the rocking lever 4 from breakage and to prevent the electrical cables 15*a* connected to the terminals from entering the space between the lever 4 and the connector 1, thereby preventing the electrical cables 15*a* from entangling the rocking lever 4. In addition, the ribs 13, 13 are arranged asymmetrically with respect to the center line of the connector housing 11 while the slide grooves 22 are formed in the connector housing 19 of the second connector 3 in association with the ribs 13, 13. This can prevent the connector housings 11 and 19 of the connectors 1 and 3 from being coupled to each other upside down.

As described above, in the electrical connector assembly of the present invention, at least one rocking lever is rotatably supported on the first connector through the support pin. The driving means for moving the rocking lever in accordance with a sliding displacement of the first connector in the holder when interconnecting the first and second connectors and the actuating means for displacing the second connector toward the first connector by transmitting the driving force of the rocking lever to the second connector while increasing the driving force are provided in and on the holder and the first connector. Each of the protection ribs is provided on the opposite sides of the mounting portion of the rocking lever to protect the lever. Accordingly, the rocking lever can be effectively protected by a simple and compact structure. It is possible to prevent the rocking lever from being broken by a contact with an obstacle or a peripheral device when carrying or using the connector assembly. It is also possible to prevent electrical cables from entering a gap between the rocking lever and the first connector, thereby preventing an entanglement of the cables on the rocking lever.

The pair of protection ribs for protecting the rocking lever are asymmetrically provided on the connector housing of the first connector. The guide grooves corresponding to the protection ribs are formed in the connector housing of the second connector. Accordingly, positioning of the connector housings can be effected by a combination of the protection ribs and guide grooves, thereby preventing the connector housings from being fitted upside down.

Also, the electrical connector assembly of the present invention comprises the first connector, the holder which holds the first connector, and the second connector being coupled to the first connector. The support lances formed on the holder hold the first connector temporarily in a waiting position for the coupling. A part of each support lance is exposed out of the first and second connectors in the complete coupling position of the first and second connectors. Accordingly, it is possible to confirm the complete coupling of the connectors by judging the extent of exposition of the distal ends of the support lances after coupling the connectors to each other, although the assembly has a simple and compact structure.

Each support lance is provided on a front part of each of the opposite sides of the holder. The second connector is provided on a rear wall thereof with openings adapted to permit distal ends of the support lances to pass therethrough. Consequently, it is possible to indicate the complete coupling of the connectors by confirming the extent of exposition of the distal ends of the support lances while preventing the interference between the support lances and the electrical cables connected to terminals of the connectors.

The rocking lever rotatably mounted on the support pin, the driving means for moving the rocking lever in accordance with a sliding displacement of the first connector along the holder when interconnecting the first and second connectors and the actuating means for displacing the second connector toward the first connector by transmitting the driving force of the rocking lever to the second connector while increasing the driving force are provided between the holder and the first connector. Accordingly, a great force can be applied to the connectors by merely pushing the first or second connector toward the second or first connector, thereby surely coupling the connectors.

From the above description of the invention, those skilled in the art will perceive improvements, changes and modifications. Such improvements, changes and modifications within the skill of the art are intended to be covered by the appended claims.

The entire disclosures of Japanese Patent Application Nos. HEI 9-176172 (1997) and HEI 9-176173 (1997) filed on Jul. 1, 1997 and Jul. 1, 1997 including specification, claims, drawings and summary are incorporated herein by reference in their entirety.

What is claimed is:

1. An electrical connector assembly comprising:

a first connector;

a second connector detachably coupled to said first connector;

a holder having a pair of support lances which detachably hold said first connector; and at least one rocking lever which is rotatably mounted on said first connector;

whereby rotary displacement of said rocking lever connects and disconnects said first and second connectors to and from each other through said holder.

2. An electrical connector assembly according to claim 1, wherein said rocking lever is rotatably supported on said first connector through a support pin, wherein driving means for turning said rocking lever in response to a sliding displacement of said first connector relative to said holder when interconnecting said first and second connectors and actuating means for displacing said second connector toward said first connector by transmitting a driving force of said rocking lever to said second connector while increasing said driving force are provided in and on said holder and said first connector, and wherein each of a pair of protection ribs is provided on the opposite sides of a mounting portion of said rocking lever to protect said lever.

3. An electrical connector assembly according to claim 1, wherein said pair of protection ribs for protecting said rocking lever are asymmetrically provided with respect to a center line of a connector housing of said first connector thereon, and wherein a pair of guide grooves corresponding to said pair of protection ribs are formed in a connector housing of said second connector.

4. An electrical connector assembly according to claim 1, wherein said pair of support lances formed on said holder hold said first connector temporarily in a waiting position for the coupling, and wherein a part of each of said support lances is exposed out of said first and second connectors in a complete coupling position of said first and second connectors.

5. An electrical connector assembly according to claim 4, wherein each of said support lances is provided on a front part of each of the opposite sides of said holder, and wherein said second connector is provided on a rear wall thereof with openings adapted to permit distal ends of said support lances to pass therethrough.

6. An electrical connector assembly according to claim 4, wherein the rocking lever rotatably mounted on a support pin, driving means for moving said rocking lever in accordance with a sliding displacement of said first connector in said holder when interconnecting said first and second connectors and actuating means for displacing said second connector toward said first connector by transmitting a driving force of said rocking lever to said second connector while increasing said driving force are provided between said holder and said first connector.

7. An electrical connector assembly according to claim 5, wherein the rocking lever rotatably mounted on a support pin, driving means for moving said rocking lever in accordance with a sliding displacement of said first connector in said holder when interconnecting said first and second connectors and actuating means for displacing said second connector toward said first connector by transmitting a driving force of said rocking lever to said second connector while increasing said driving force are provided between said holder and said first connector.

* * * * *

UNITED STATES PATENT AND TRADEMARK OFFICE

CERTIFICATE OF CORRECTION

PATENT NO : 6,120,308

DATED : Sept. 19, 2000

INVENTOR(S) : H. Hayashi

It is certified that error appears in the above-identified patent and that said Letters Patent are hereby corrected as shown below:

Face of patent, at [73] Assignees:, change the second assignee to read --Harness System Technologies Research, Ltd.--

Signed and Sealed this

First Day of May, 2001

Nicholas P. Godici

*Attest:*

NICHOLAS P. GODICI

*Attesting Officer*

*Acting Director of the United States Patent and Trademark Office*